US006516978B1

(12) United States Patent
Chapman

(10) Patent No.: US 6,516,978 B1
(45) Date of Patent: Feb. 11, 2003

(54) GARMENT SIZER

(76) Inventor: Mary Lou Chapman, 3748 Hunters Glenn, Cibolo, TX (US) 78108

( * ) Notice: Subject to any disclaimer, the term of this patent is extended or adjusted under 35 U.S.C. 154(b) by 0 days.

(21) Appl. No.: 09/977,668

(22) Filed: Oct. 15, 2001

Related U.S. Application Data

(60) Provisional application No. 60/249,884, filed on Nov. 17, 2000.

(51) Int. Cl.[7] ..... A41H 5/00
(52) U.S. Cl. ..... 223/69
(58) Field of Search ..... 223/69

(56) References Cited

U.S. PATENT DOCUMENTS 2,307,256 A * 1/1943 Burwell ..... 223/69

* cited by examiner

*Primary Examiner*—Rodney M. Lindsey
*Assistant Examiner*—James G Smith

(57) ABSTRACT

A garment sizer that includes a torso support frame for supporting the torso area of a garment while drying or storing the garment that has a hanger hook provided at the top end thereof for hanging the device from a rail. The device also includes a pair of user adjustable garment arm hole supports that are sizable to fit into the arm holes of the garment and maintain them in the proper shape while the garment is drying and/or being stored.

1 Claim, 2 Drawing Sheets

GARMENT SIZER

This application claims the benefit of provisional application No. 60/249,884, filed Nov. 17, 2000.

TECHNICAL FIELD

The present invention relates to garment storage accessories and more particularly to an adjustable sweater sizer including a body stretching portion including a central multi-tiered center tubular section having three spaced parallel oriented tubular members extending from a vertical oriented center member having a hanging hook provided at the top end thereof, two E-shaped members each having three tubular members that are spaced and sized to slide into one of the two open ends of the three parallel oriented tubular members and having apertures that are alignable with apertures in the tubular portions of the center member so that the user can adjust the width of the body stretching portion; and two adjustable garment arm hole supports each including a pair of inter connectable members that snap fit to an exterior facing surface of one of the E-members and each of which have a vertical adjustment mechanism so that the width of the arm hole support may be adjusted and sized to fit a particular garment; in use the garment sizer being used to maintain the shape of garments such as sweaters which have a tendency to become misshapen when hung on a hanger to dry.

BACKGROUND OF INVENTION

Some Garments must be held in a desired shape while drying to prevent the garment from becoming misshapen. For instance hanging a wet sweater on a hanger to dry can make the sweater unwearable because pressure points generated by the hanger during drying and/or storage cause undesirable markings or stretch marks on the sweater. It would be desirable, therefore, to have a garment sizing hanger that included a body support framework that could be adjusted to support and hold the torso portion of the garment in the proper shape and a pair of arm opening supports that can be adjusted to fit into and maintain the openings to the sleeve areas of the garment in the proper shape during drying and/or storage of the garment.

SUMMARY OF INVENTION

It is thus an object of the invention to provide a garment sizer that includes a central multi-tiered center tubular section having three spaced parallel oriented tubular members extending from a vertical oriented center member having a hanging hook provided at the top end thereof, two E-shaped members each having three tubular members that are spaced and sized to slide into one of the two open ends of the three parallel oriented tubular members and having apertures that are alignable with apertures in the tubular portions of the center member so that the user can adjust the width of the body stretching portion; and two adjustable garment arm hole supports each including a pair of inter connectable members that snap fit to an exterior facing surface of one of the E-members and each of which have a vertical adjustment mechanism so that the width of the arm hole support may be adjusted and sized to fit a particular garment; in use the garment sizer being used to maintain the shape of garments such as sweaters which have a tendency to become misshapen when hung on a hanger to dry.

Accordingly, a garment sizer is provided. The garment sizer includes a central multi-tiered center tubular section having three spaced parallel oriented tubular members extending from a vertical oriented center member having a hanging hook provided at the top end thereof, two E-shaped members each having three tubular members that are spaced and sized to slide into one of the two open ends of the three parallel oriented tubular members and having apertures that are alignable with apertures in the tubular portions of the center member so that the user can adjust the width of the body stretching portion; and two adjustable garment arm hole supports each including a pair of inter connectable members that snap fit to an exterior facing surface of one of the E-members and each of which have a vertical adjustment mechanism so that the width of the arm hole support may be adjusted and sized to fit a particular garment; in use the garment sizer being used to maintain the shape of garments such as sweaters which have a tendency to become misshapen when hung on a hanger to dry.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY EMBODIMENTS

Figure 1:
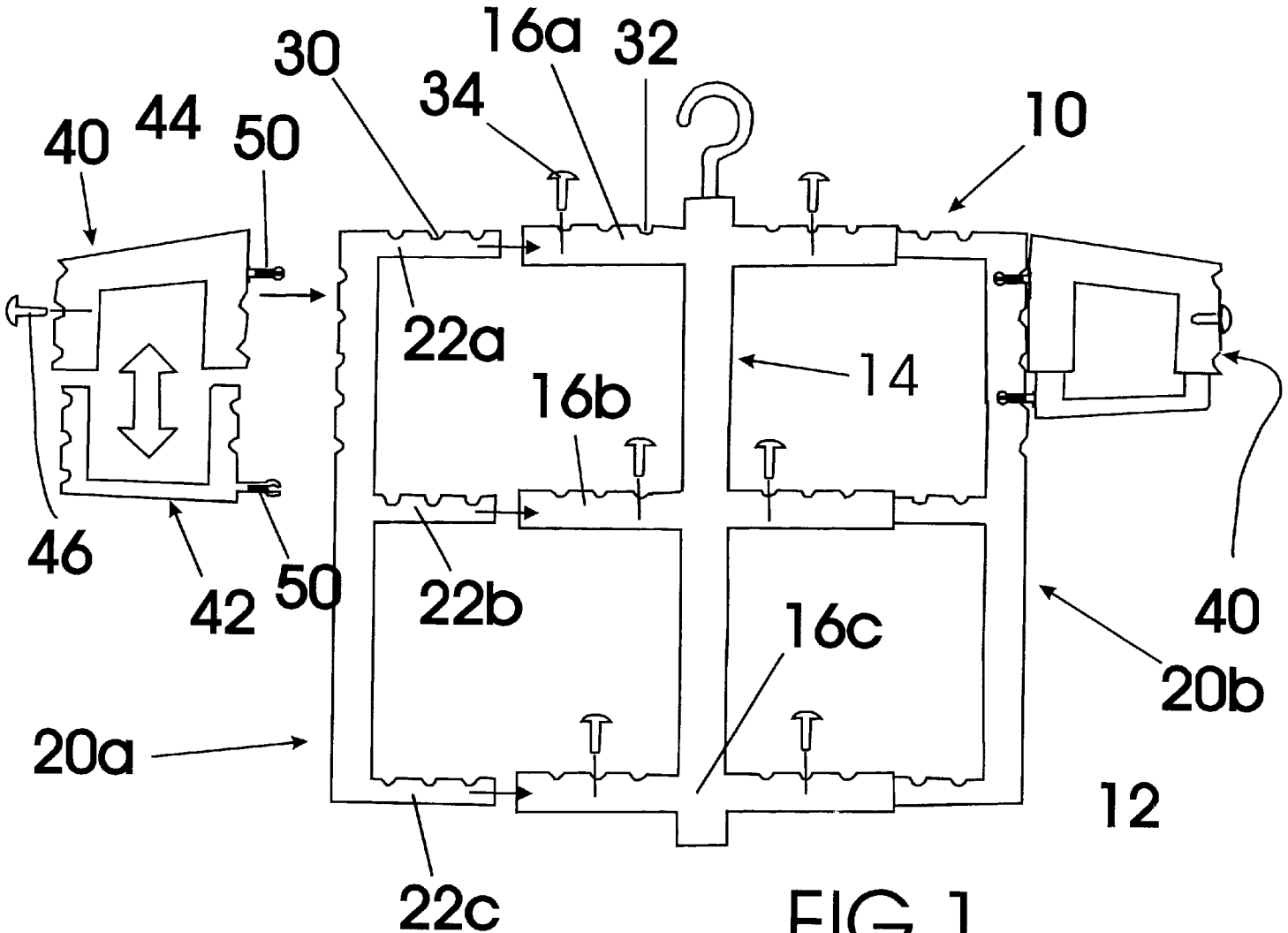
FIG. 1 shows an exploded plan view of the exemplary embodiment of the garment sizer hanger of the present invention.
Figure 2:
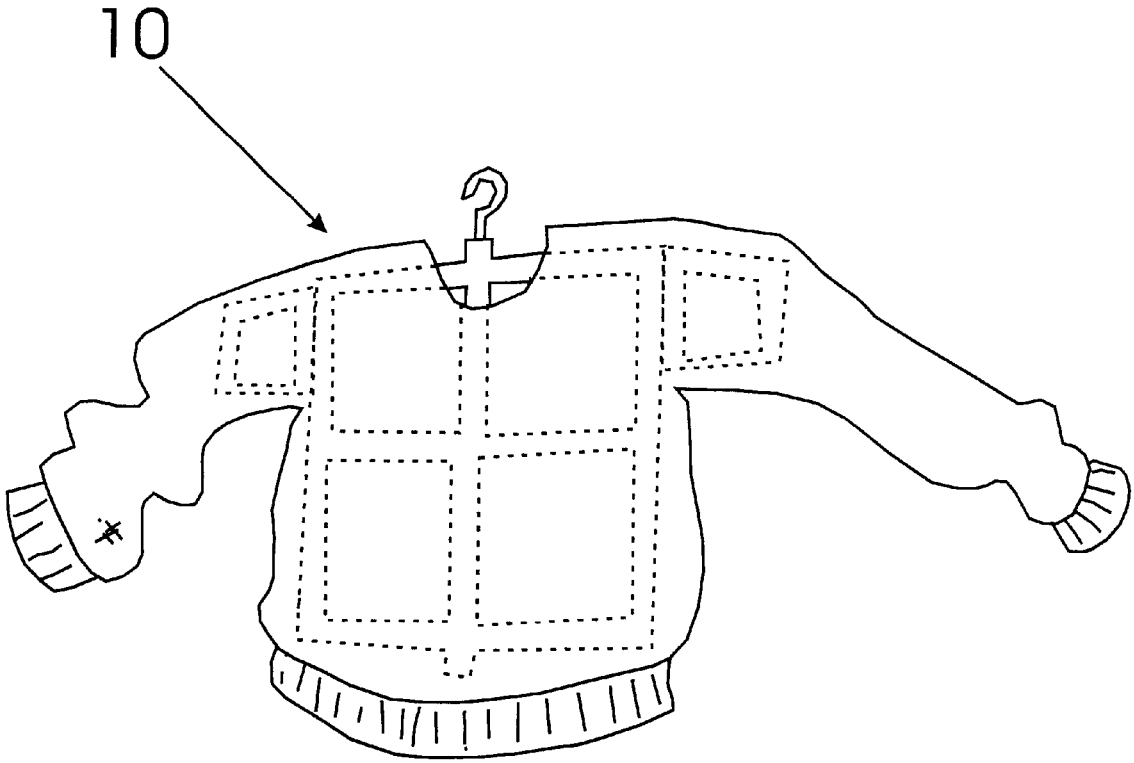
FIG. 2 shows a representative garment with the exemplary garment sizer hanger installed therein shown in dashed lines.

FIGS. 1 and 2 show various aspects of an exemplary embodiment of the garment sizer of the present invention generally designated 10. Garment sizer 10 includes a body stretching portion generally designated 12 having a multi-tiered center tubular section generally designated 14 having three spaced parallel oriented tubular members 16*a,* 16*b* and 16*c;* and two E-shaped members generally designated 20*a,* 20*b* that each have three tubular members 22*a,* 22*b,* and 22*c* that are sized and spaced to slide into one of the two opened ends of the three parallel oriented tubular members 16*a–c.* Apertures 30 and 32 are then alignable and the E-shaped member is secured to center tubular section 14 using multiple locking pins 34.

Garment sizer 10 also includes two adjustable garment hole supports each generally designated 40 that each include a pair of inter connectable members 42, 44 that are connectable with pins 46 to adjust the width thereof and which are snap fittable to an E-shaped member 20*a*/20*b* using snap inserts 50.

It can be seen from the preceding description that a garment sizer has been provided.

It is noted that the embodiment of the garment sizer described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A garment sizer for supporting and holding a garment in a proper shape during drying and/or storage of the garment; the garment sizer comprising:

a central multi-tiered center tubular section having three spaced parallel oriented tubular members extending from a vertical oriented center member having a hanging hook provided at the top end thereof;

two E-shaped members each having three tubular members that are spaced and sized to slide into one of the two open ends of the three parallel oriented tubular members and having apertures that are alignable with apertures in the tubular portions of the center member so that the user can adjust the width of the body stretching portion; and two adjustable garment arm hole supports each including a pair of inter-connectable members that snap fit to an exterior facing surface of one of the E-members and each of which have a vertical adjustment mechanism so that the width of the arm hole support may adjusted and sized to fit a particular garment.

* * * * *